United States Patent [19]

Graham

[11] Patent Number: 4,620,649

[45] Date of Patent: Nov. 4, 1986

[54] DEVICE FOR TURNING FABRIC SLEEVES

[76] Inventor: Donell I. Graham, 2415 Glory C Rd., Medford, Oreg. 97501

[21] Appl. No.: 710,582

[22] Filed: Mar. 11, 1985

[51] Int. Cl.[4] ..... A41H 43/00

[52] U.S. Cl. ..... 223/40; 223/42

[58] Field of Search ..... 223/40, 41, 42; 81/3.1 A, 3.1 B, 3.1 C, 3.1 D, 3.35, 3.33, 3.45

[56] References Cited

U.S. PATENT DOCUMENTS

| | | | |
|---|---|---|---|
| 330,974 | 11/1885 | Friedman et al. | 81/3.45 |
| 783,800 | 2/1905 | Porter | 81/3.35 |
| 2,626,090 | 1/1953 | Horsley | 223/42 |
| 2,715,983 | 8/1955 | Fraser | 223/42 |
| 3,945,542 | 3/1976 | Taylor | 223/42 |
| 4,196,681 | 4/1980 | Chietti | 223/42 |

FOREIGN PATENT DOCUMENTS

| | | | |
|---|---|---|---|
| 21716 | 3/1936 | Australia | 223/40 |

*Primary Examiner*—Louis K. Rimrodt
*Assistant Examiner*—Joseph S. Machuga
*Attorney, Agent, or Firm*—John R. Murtha

[57] ABSTRACT

A device for turning tubular fabric sleeves. The device comprises a narrow hollow inverting tube and a long rigid wire fabric puller. The fabric puller is equipped with a handle on one end and a plurality of helical turns on the other end. The last of the helical turns is arranged at a 90 degree angle relative to the centerline of the wire so as to form a ledge for the fabric sleeve to bear against.

1 Claim, 5 Drawing Figures

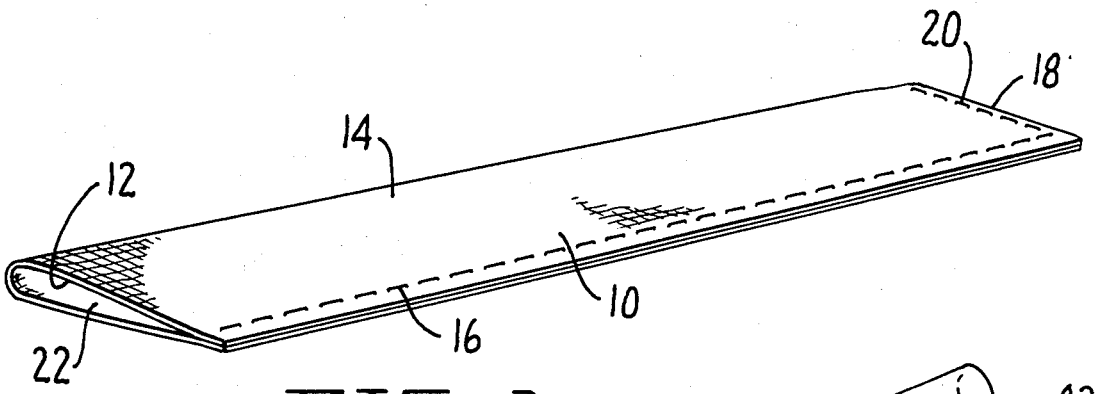
FIG. 1.
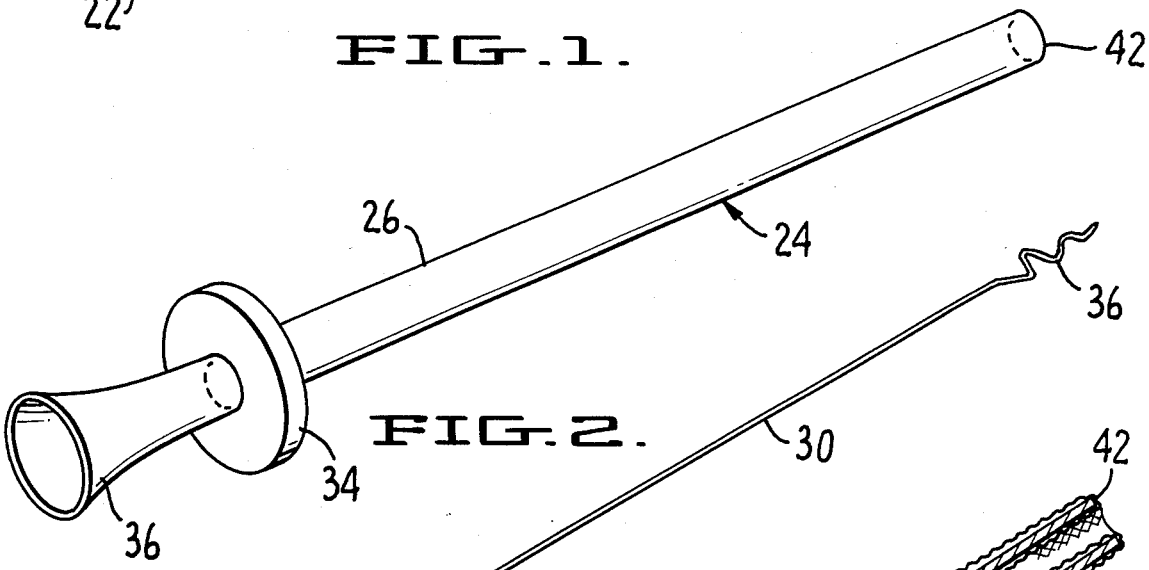
FIG. 2.
FIG. 3.
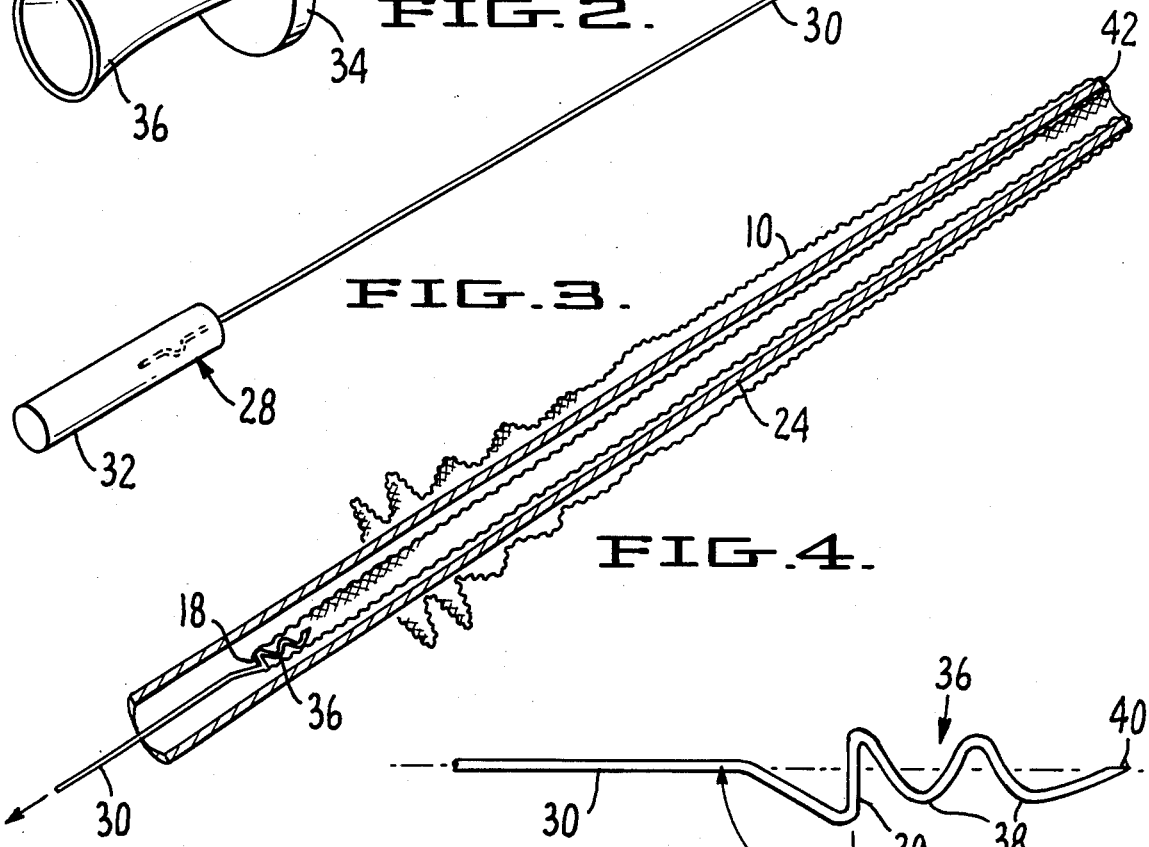
FIG. 4.
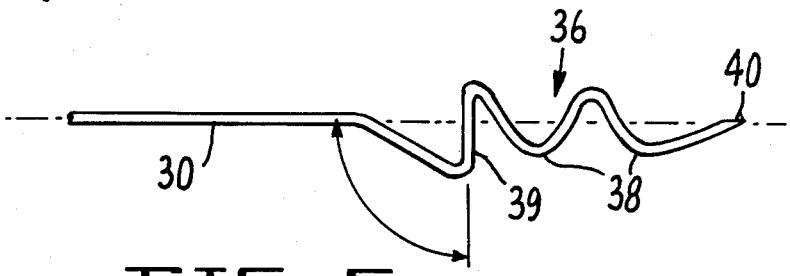
FIG. 5.

DEVICE FOR TURNING FABRIC SLEEVES

The invention relates to sewing notions and, more particularly, to a novel device for turning long, narrow fabric tubes or sleeves such as those formed in the making of straps, belts and other similar items for women's and children's clothes.

In the sewing of women's and children's clothes it is often necessary to make a long and narrow tubular piece of fabric to serve as a strap or a belt. In making the tubular sleeve the fabric is turned inside out and a seam is sewn along one edge. The fabric is then inverted, i.e. turned right-side out, so that the seam is hidden and the finished side of the fabric is showing. When the sleeve is relatively long and narrow turning the sleeve right-side out can be a very difficult task.

Heretofore, the principal method for inverting a fabric tube has required the use of a piece of yarn or string that is sewn to one end of the cloth sleeve while the sleeve is inside out. The fabric is then manually turned upon itself while the sewer holds onto the yarn or string. This method requires a great deal of manual dexterity and is sufficiently cumbersome and difficult that even exceptionally good sewers avoid it if at all possible.

The present invention has for its object the provision of a simple tool that will enable the sewer to turn long, narrow sleeves or tubes of fabric, or other similar material, easily and quickly.

In the drawings which accompany the application, and in which similar reference numerals refer to similar parts:

FIG. 1 is a perspective view of a tubular fabric sleeve with the inside of the fabric on the outside and showing the longitudinal seam before the sleeve is turned, FIG. 2 is a perspective view of one part of the applicant's turning device, FIG. 3 is a perspective view of the second part to the applicant's tool, FIG. 4 is a partial, sectional view showing the fabric sleeve being turned by the applicant's device, and FIG. 5 is a detailed view of the hook construction on the second part of applicant's device.

FIG. 1 shows a long, narrow fabric sleeve or tube 10 that is to be used as a belt or strap on a woman's dress. The fabric is inside out, that is, the finished side 12 of the fabric is on the inside and the unfinished side 14 of the fabric is on the outside. A longitudinal seam 16 has been sewn along one side of the fabric sleeve and one end 18 of the sleeve has also been closed by a seam 20. This construction gives the fabric sleeve 10 an open end 22 and a closed end 18. Excess fabric beyond the two seams 16,20 is then cut away so a minimum of fabric is left. The fabric sleeve is now ready to be inverted i.e., turned right-side out through the use of applicant's device.

As seen in FIGS. 2 and 3, applicant's device comprises two parts; a first part, called an inverting tube 24, having a long, narrow, hollow tubular body 26, and a second part, called a fabric puller 28, having a long, rigid wire 30 mounted in a handle 32. The inverting tube 24 is preferably formed from a suitable thin-walled metallic tubing, preferably aluminum or steel, but other suitable materials may also be used as long as the wall thickness of the tubing is relatively thin compared to the tubing's diameter. As seen in the drawing, the inverting tube 24 is provided with a collar 34 that is secured to the tubular body by means of a suitable adhesive at a point near an end 36 of the tubular body that is flared outwardly. It is preferred to make the collar 34 out of a color coded plastic for purposes of easy identification as will be explained in more detail hereafter, but this identification feature is an optional one and not strictly necessary and other materials could be used for the collar.

The fabric puller 28 comprises a long, rigid wire 30 that is secured at one end in a handle 32. It is preferred to form the handle 32 from the same color coded plastic used to make the collar 34 on the inverting tube. To accomodate various sized sleeves or tubes it is necessary to utilize one or more devices of varying size. The smaller the fabric tube or sleeve to be turned, the smaller the inverting tube 24 must be. Inasmuch as the fabric puller wire 30 must fit within the inverting tube 24, it also must be small enough to use on small fabric sleeves and tubes. By color coding the collars 34 and handles 32 matching inverting tubes and fabric pullers can be readily identified.

The opposite or free end of the wire 30 is formed into a spiral hook 36 that is used to engage the fabric to be turned. As is best seen in FIG. 5, the end of the wire 30 is formed with a number of spiral turns 38,38 that terminate in a point 40 which lies substantially parallel to the center line of the wire. The last spiral turn 39 in the hook 36 is formed approximately at a right angle to the wire 30 so as to form a definite ledge for the fabric to bear against during the turning of the fabric.

In operation, the inverting tube 24 is inserted into the opening 22 in the fabric sleeve 10 and the fabric pulled down over the tubular body 26 against the collar 34 until the closed end 18 of the cloth sleeve presses against the open end 42 of the tube 24. The fabric puller 28 is then inserted into the flared end 26 of the inverter tube 24. The puller 28 is inserted far enough for the hook 36 at the end of the wire 30 to pierce the closed end 18 of the fabric sleeve. Rotation of the handle of the puller 28 causes the hook 36 to penetrate the fabric and to securely lodge the fabric onto the puller. With the puller 28 thus hooked into the fabric the puller is withdrawn through the inverter tube 24. As the puller is withdrawn the fabric is pulled down through the inside of the tubular body 26 of the inverter and out through the flared opening 26 (see FIG. 4). This action turns the fabric right-side out in one quick, easy stroke of the wire puller. The hook 34 is then readily detached from the cloth tube by rotating or unscrewing, the puller.

It will be seen that the open end 42 of the hollow tubular body 26 serves as a plane-defining surface past which the fabric puller 28 draws the fabric as it is being turned. It is this action that enables the applicant's device to readily invert the fabric from a wrong-side out condition to a right-side out condition.

I claim:

1. A device for turning a tubular fabric sleeve having an interior opening closed at one end, said device comprising:

(a) a hollow member insertable into the interior opening of the fabric sleeve, said member having a plane-defining surface, (b) a second member insertable into said hollow member having means for engaging the fabric sleeve and movable to pull the fabric sleeve past the plane-defining surface interiorly of the hollow member, (c) said means comprising a metallic wire having a pointed end for piercing said fabric sleeve and a plurality of helical turns formed adjacent said free end thereof wherein the last of said turns is set substantially 90 degrees to the centerline of the wire so as to form a definite ledge for the fabric sleeve to bear against during the turning of the fabric.

* * * * *